US010287864B2

(12) United States Patent
Chen et al.

(10) Patent No.: US 10,287,864 B2
(45) Date of Patent: May 14, 2019

(54) NON-CONDENSABLE GAS COINJECTION WITH FISHBONE LATERAL WELLS

(71) Applicant: CONOCOPHILLIPS COMPANY, Houston, TX (US)

(72) Inventors: Bo Chen, Houston, TX (US); Qing Chen, Houston, TX (US); Thomas J. Wheeler, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 324 days.

(21) Appl. No.: 14/956,030

(22) Filed: Dec. 1, 2015

(65) Prior Publication Data

US 2016/0341021 A1 Nov. 24, 2016

Related U.S. Application Data

(60) Provisional application No. 62/086,035, filed on Dec. 1, 2014.

(51) Int. Cl.

| | |
|---|---|
| ***E21B 43/16*** | (2006.01) |
| ***E21B 43/24*** | (2006.01) |
| ***E21B 43/30*** | (2006.01) |

(52) U.S. Cl.

CPC ..... *E21B 43/2408* (2013.01); *E21B 43/164* (2013.01); *E21B 43/166* (2013.01); *E21B 43/305* (2013.01)

(58) Field of Classification Search

CPC .. E21B 43/24; E21B 43/2406; E21B 43/2408; E21B 43/305; E21B 43/164; E21B 43/166

See application file for complete search history.

(56) References Cited

U.S. PATENT DOCUMENTS

| | | | | |
|---|---|---|---|---|
| 5,273,111 | A | 12/1993 | Brannan | |
| 5,803,171 | A | 9/1998 | McCaffrey | |
| 6,257,334 | B1 | 7/2001 | Cyr | |
| 7,556,099 | B2 | 7/2009 | Arthur | |
| 8,327,936 | B2 | 12/2012 | Coskuner | |
| 8,689,865 | B2 | 4/2014 | Banerjee | |
| 2007/0295499 | A1* | 12/2007 | Arthur | E21B 43/2406 166/245 |
| 2009/0255661 | A1* | 10/2009 | Clark | E21B 41/0035 166/50 |
| 2012/0247760 | A1* | 10/2012 | Wheeler | E21B 43/2406 166/272.3 |
| 2012/0292055 | A1 | 11/2012 | Swist | |
| 2014/0034296 | A1 | 2/2014 | Chen et al. | |
| 2014/0124194 | A1 | 5/2014 | Jorshari | |
| 2015/0114637 | A1 | 4/2015 | Lo | |

* cited by examiner

*Primary Examiner* — Brad Harcourt
*Assistant Examiner* — David Carroll
(74) *Attorney, Agent, or Firm* — ConocoPhillips Company

(57) ABSTRACT

Producing hydrocarbons by steam assisted gravity drainage, more particularly utilizing conventional horizontal wellpair configuration of SAGD in conjunction of infill production wells the production wells comprising two or more fishbone lateral wells to inject steam initially and then switch to NCG-steam coinjection after establishing thermal communication between the thermal chamber and infill well.

3 Claims, 3 Drawing Sheets

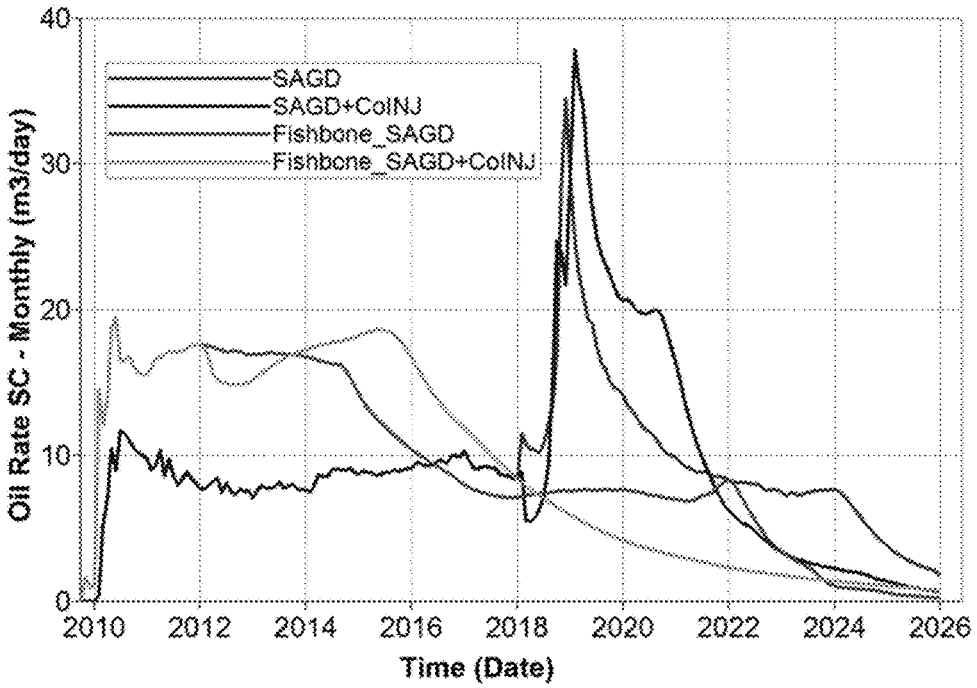
Figure 3: Monthly oil production
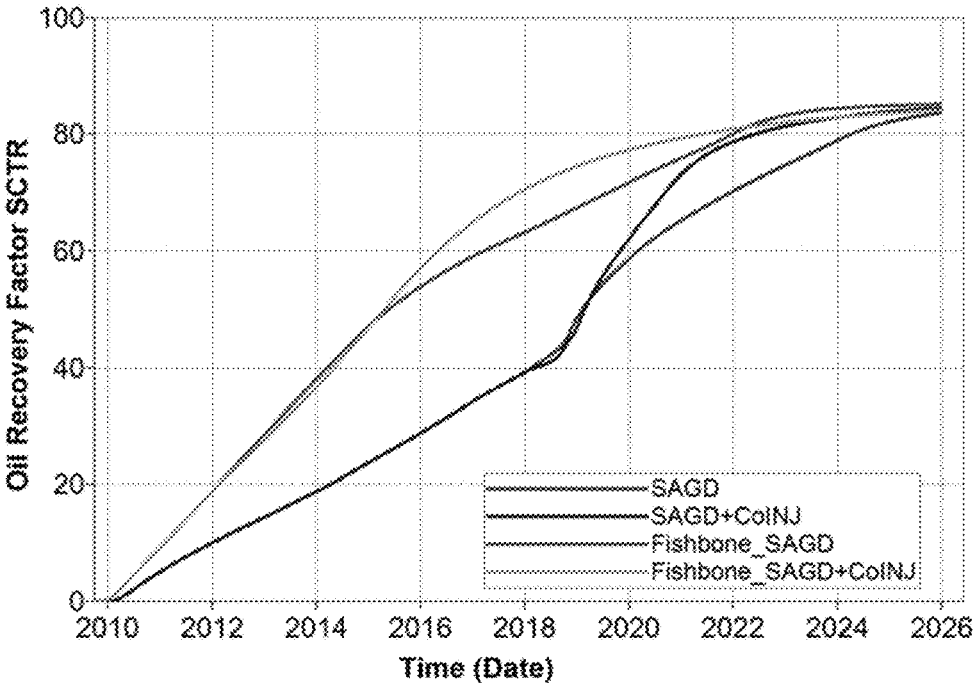
Figure 4: Oil recovery factor

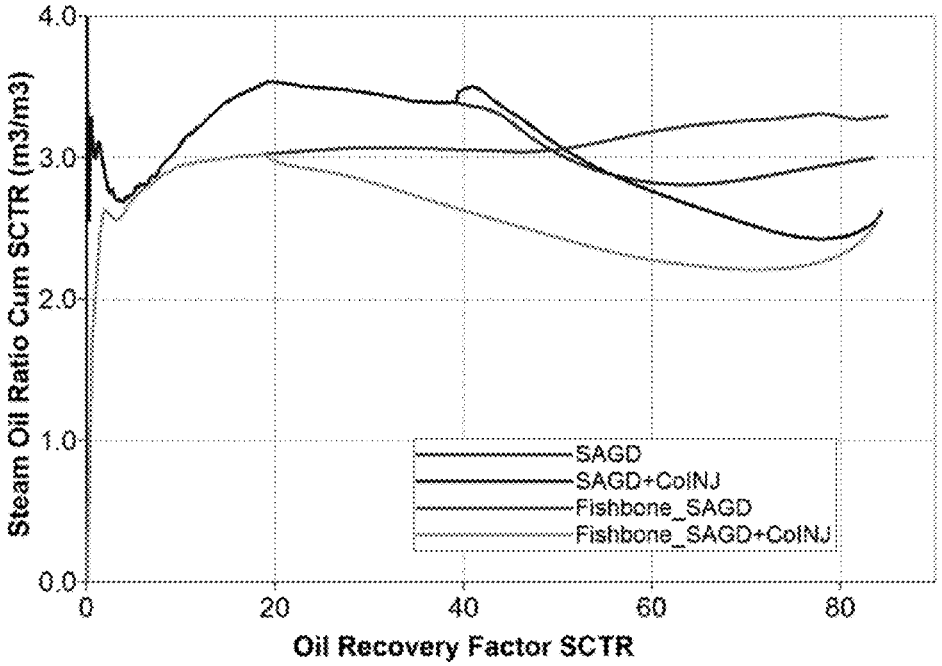
Figure 5: Cumulative steam-oil ratio

NON-CONDENSABLE GAS COINJECTION WITH FISHBONE LATERAL WELLS

CROSS-REFERENCE TO RELATED APPLICATIONS

This application is a non-provisional application which claims benefit under 35 USC § 119(e) to U.S. Provisional Application Ser. No. 62/086,035 filed Dec. 1, 2014, entitled "NON-CONDENSABLE GAS COINJECTION WITH FISHBONE LATERAL WELLS," which is incorporated herein in its entirety.

STATEMENT REGARDING FEDERALLY SPONSORED RESEARCH

None.

FIELD OF THE INVENTION

The present invention relates generally to producing hydrocarbons by steam assisted gravity drainage. More particularly, but not by way of limitation, embodiments of the present invention include utilizing conventional horizontal wellpair configuration of SAGD in conjunction with infill production wells the production wells comprising two or more fishbone lateral wells to inject steam initially and then switch to NCG-steam coinjection after establishing thermal communication between the thermal chamber and infill well.

BACKGROUND OF THE INVENTION

Bitumen recovery from oil sands presents technical and economic challenges due to high viscosity of the bitumen at reservoir conditions. Steam assisted gravity drainage (SAGD) provides one process for producing the bitumen from a reservoir. During SAGD operations, steam introduced into the reservoir through a horizontal injector well transfers heat upon condensation and develops a steam chamber in the reservoir. The bitumen with reduced viscosity due to this heating drains together with steam condensate along a boundary of the steam chamber and is recovered via a producer well placed parallel and beneath the injector well.

However, costs associated with energy requirements for the SAGD operations limit economic returns. Accumulation in the reservoir of gaseous carbon dioxide ($CO_2$) and/or solvent that may be injected with the steam in some applications can further present problems. For example, the gaseous $CO_2$/solvent acts as a thermal insulator impairing heat transfer from the steam to the bitumen, decreases temperature of the drainage interface due to partial pressure impact, and decreases effective permeability to oil as a result of increased gas saturation.

Therefore, a need exists for methods and systems for recovering hydrocarbons from oil sands with an efficient steam-to-oil ratio.

BRIEF SUMMARY OF THE DISCLOSURE

This invention proposes a new in-situ oil sands/heavy oil recovery process that combines fishbone technology and non-condensable gas (NCG)-steam coinjection to accelerate oil recovery and improve energy efficiency. This new process targets mainly at reservoirs with specific geologic settings that have good quality pay, such as clean sand, overlaid by relatively poor quality pay, such as inclined heterolithic stratification (IHS) layers. In those reservoirs, conventional SAGD normally yields a high steam-oil ratio (SOR) due to the inefficient oil drainage from IHS layers by steam. NCG-steam coinjection with the use of infill wells in those SAGD reservoirs can efficiently enhance oil drainage from IHS layers and reduce SOR; however, NCG-steam coinjection cannot start until 4-8 years of SAGD operation when the thermal communication between the steam chamber and infill producer is established. To address such an issue, we propose the use of fishbone well configuration, for either infill producers or SAGD wells, or for both, to promote steam chamber lateral development and thus allow early start of NCG-steam coinjection, resulting in further SOR reduction and better economics. Our simulation shows that NCG-steam coinjection can be started after only 2 years of SAGD operation with 20% oil recovery by using fishbone well configuration for infill producers as compared to 8 years of SAGD operation with 40% oil recovery for the case conventional infill producers. Better CSOR reduction is also confirmed by simulation for the proposed process.

A process for producing hydrocarbons where the process comprises:

- a reservoir having a good quality pay overlaid by relatively poorer quality pay;
- a horizontal wellpair comprising an injection well and a production well;
- one or more infill production wells;
- initially injecting steam through said injection well;
- establishing thermal communication between the thermal chamber and one or more infill production wells;
- switching to co-injection of NCG and steam; and
- producing hydrocarbons the production wells having fishbone ribs drilled laterally from the production well.

The hydrocarbons produced include heavy oil, bitumen, tar sands, extra heavy oil, and the like.

NCG may be air, carbon dioxide ($CO_2$), nitrogen ($N_2$), carbon monoxide (CO), hydrogen sulfide ($H_2S$), hydrogen ($H_2$), anhydrous ammonia ($NH_3$), flue gas, or combinations thereof.

As used herein, "bitumen" and "extra heavy oil" are used interchangeably, and refer to crudes having less than 10° API.

As used herein, "heavy oil" refers to crudes having less than 22° API. The term heavy oil thus includes bitumens, unless it is clear from the context otherwise.

By "horizontal production well", what is meant is a well that is roughly horizontal (>45° off a horizontal plane) where it is perforated for collection of mobilized heavy oil. Of course, it will have a vertical portion to reach the surface, but this zone is typically not perforated and does not collect oil.

By "vertical" well, what is meant is a well that is roughly vertical (<45° off a vertical line).

By "injection well" what is meant is a well that is perforated, so that steam or solvent can be injected into the reservoir via said injection well. An injection well can easily be converted to a production well (and vice versa), by ceasing steam injection and commencing oil collection.

Thus, injection wells can be the same as production wells, or separate wells can be provided for injection purposes. It is common at the start up phase for production wells to also be used for injection, and once fluid communication is established, switched to production uses.

As used herein a "production stream" or "production fluid" or "produced heavy oil" or similar phrase means a crude hydrocarbon that has just been pumped from a reservoir and typically contains mainly heavy oil and/or bitumen and water, and may also contain additives such as solvents, foaming agents, and the like.

By "mobilized" oil, what is meant is that the oil viscosity has been reduced enough for the mobilized oil to be produced.

By "steam", we mean a hot water vapor, at least as provided to an injection well, although some steam will of course condense as the steam exits the injection well and encounters cooler rock, sand or oil. It will be understood by those skilled in the art that steam usually contains additional trace elements, gases other than water vapor, and/or other impurities. The temperature of steam can be in the range of about 150° C. to about 350° C. However, as will be appreciated by those skilled in the art, the temperature of the steam is dependent on the operating pressure, which may range from about 100 psi to about 2,000 psi (about 690 kPa to about 13.8 MPa).

In the case of either the single or multiple wellbore embodiments of the invention, if fluid communication is not already established, it must be established at some point in time between the producing wellbore and a region of the subterranean formation containing the hydrocarbon fluids affected by the injected fluid, such that heavy oils can be collected from the producing wells.

By "fluid communication" we mean that the mobility of either an injection fluid or hydrocarbon fluids in the subterranean formation, having some effective permeability, is sufficiently high so that such fluids can be produced at the producing wellbore under some predetermined operating pressure. Means for establishing fluid communication between injection and production wells includes any known in the art, including steam circulation, geomechanically altering the reservoir, RF or electrical heating, ISC, solvent injection, hybrid combination processes and the like.

By "start up" what is meant is that period of time when most or all wells are being used for steam injection in order to establish fluid communication between the wells. Start-up typically requires 3-6 months in traditional SAGD.

By "providing" wellbores herein, we do not imply contemporaneous drilling. Therefore, either new wells can be drilled or existing wells can be used as is, or retrofitted as needed for the method.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBRE-VIATION | TERM |
|---|---|
| API | American Petroleum Institute |
| API gravity | To derive the API gravity from the density, the density is first measured using either the hydrometer, detailed in ASTM D1298 or with the oscillating U-tube method detailed in ASTM D4052. Direct measurement is detailed in ASTM D287. |
| bbl | barrel |
| Cp | Centipoise |
| CSOR | Cumulative steam/oil ratio |
| CSS | Cyclic Steam Stimulation |
| cSt | Centistokes. Kinematic viscosity is expressed in centistokes |
| DSG | Direct Steam Generation |
| EOR | Enhanced oil recovery |
| ES-SAGD | Expanding solvent-SAGD |
| NCG | Non-condensable gas |
| OOIP | Original oil In place |
| OTSG | Once-through steam generator |
| SAGD | Steam assisted gravity drainage |
| SAGP | Steam and gas push |
| SAP | Solvent assisted process or Solvent aided process |
| SCTR | Sector recovery |
| SF | Steam flooding |
| SF-SAGD | Steam flood SAGD |
| SOR | Steam-to-oil ratio |
| THAI | Toe to heal air injection |
| VAPEX | Vapor extraction |
| XSAGD | Cross SAGD where producers and injectors are perpendicular and used in an array. |

BRIEF DESCRIPTION OF THE DRAWINGS

A more complete understanding of the present invention and benefits thereof may be acquired by referring to the follow description taken in conjunction with the accompanying drawings in which:

FIG. 3 illustrates monthly oil production over time, FIG. 4 illustrates oil recovery factor over time, and FIG. 5 illustrates cumulative steam-oil ratio over time.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Previously, Chen, et al. (US 2014-0034296) produce hydrocarbons by steam assisted gravity drainage with dual producers separated vertically and laterally from at least one injector. Lo and Chen (U.S. Ser. No. 14/524,205) improve hydrocarbon recovery utilizing alternating steam and steam-plus-additive injections.

Reservoirs containing clean sand overlaid by IHS layers of low vertical permeability are not uncommon in the Athabasca oil sands. Based on our recent study, this geologic setting with IHS layers overlaying clean sand is unfavorable for SAGD processes because of the difficulty of steam invasion into IHS layers to drain oil without reaching saturated steam temperature. NCG, however, can move into regions within and above IHS layers even when the temperatures of those regions are still below steam temperature yet high enough to mobilize in-situ viscous oil. Coinjection of NCG with steam at the appropriate timing not only enhances oil recovery from IHS layers but also improves energy efficiency as a result of NCG accumulation on top of the reservoir. The timing of NCG coinjection depends on the lateral growth of the steam chamber and heating of bitumen in the upper layers by heat conduction. Normally, infill producers are used in conjunction with NCG coinjection to accelerate the oil production. The optimal timing of NCG coinjection, according to our recent study, is the time when the thermal communication between the steam chamber and the infill producers is established. The typical time of SAGD operation before NCG coinjection is 4-8 years, which is mainly determined by the thickness and permeability of the lower clean sand pay.

Figure 1:
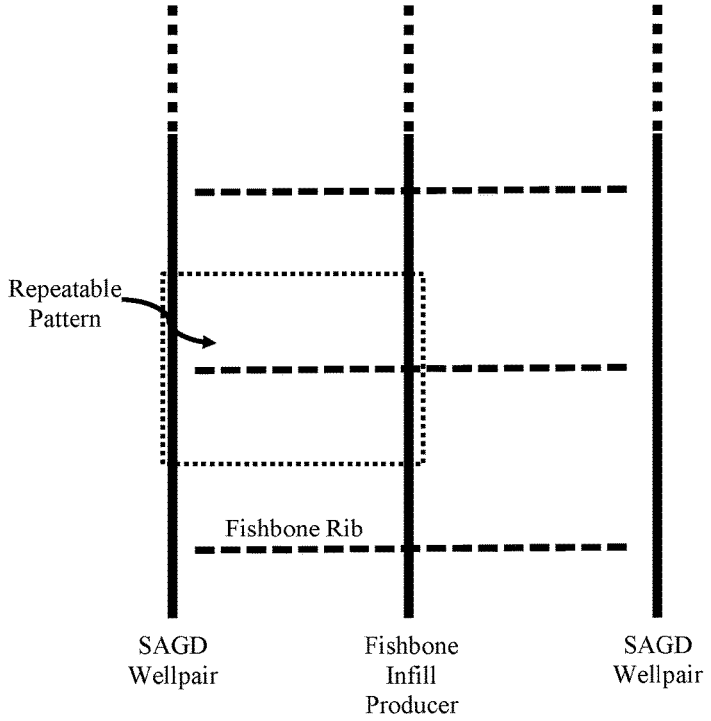
FIG. 1 is a schematic of well configuration with fishbone infill producer and the repeatable pattern for simulation.

Fishbone technology can effectively increase the contact area between horizontal intervals and reservoirs and boost oil production. Implementation of the fishbone technology, either for the infill producers or the SAGD injectors/producers, or both, can significantly shorten the time of steam only injection (SAGD) prior to NCG-steam coinjection and thereby maximizing SOR reduction benefits and consequently economics. FIG. 1 shows one of the fishbone technology implementations in which a fishbone infill producer with alternating ribs is placed at the midway of two adjacent SAGD wellpairs. The open-hole fishbone ribs are drilled laterally from the infill producer and all the way to the wellpair producer. These open-hole ribs effectively enhance local permeability and allow steam to transport from the infill producer during the preheating stage, and thereby heat up the cold bitumen between the horizontal intervals. After preheating stage, steam is injected through the wellpair injector. In addition to the steam override and draining bitumen by gravity, the pressure difference between the injector and the infill producer triggers viscous force that pushes movable oil towards the infill producer. The lateral movement of mobile liquid further enhances steam chamber lateral development. After establishing early communication between the SAGD wellpair and the infill producer, NCG, such as methane, flue gas, air, or CO2, is coinjected with steam at a designed concentration, varying from 0.1 mol % to 5 mol % through the SAGD injector. The coinjected NCG can invade into the upper layers whose temperature is warm enough to make bitumen mobile while not hot enough, i.e., steam temperature to allow existence of live steam. The invasion of NCG into the upper layers provides pressure support and triggers countercurrent flow to drainage oil without heating the rock matrix to steam temperature. Also, as NCG accumulates in the upper part of the reservoir, the blanket effect of NCG help reduce significantly heat loss to overburden. The above mechanisms of NCG result in dramatic reduction of steam oil ratios. With continuous NCG-steam coinjection, the NCG/steam chamber grows both vertically and laterally. In the late stage of the process, the concentration of NCG can gradually increase to save steam while maintain reservoir pressure.

The NCG refers to a chemical that remains in the gaseous phase under process conditions within the formation. Examples of the NCG include, but are not limited to, air, carbon dioxide ($CO_2$), nitrogen ($N_2$), carbon monoxide (CO), hydrogen sulfide ($H_2S$), hydrogen ($H_2$), anhydrous ammonia ($NH_3$) and flue gas. Flue gas or combustion gas refers to an exhaust gas from a combustion process that may otherwise exit to the atmosphere via a pipe or channel. Flue gas often comprises nitrogen, $CO_2$, water vapor, oxygen, CO, nitrogen oxides ($NO_x$) and sulfur oxides ($SO_x$). The NCG can make up from 1 to 40 volume percent of a mixture that is injected into the formation.

The following examples of certain embodiments of the invention are given. Each example is provided by way of explanation of the invention, one of many embodiments of the invention, and the following examples should not be read to limit, or define, the scope of the invention.

Example 1: Simulated Oil Recovery

Figure 2:
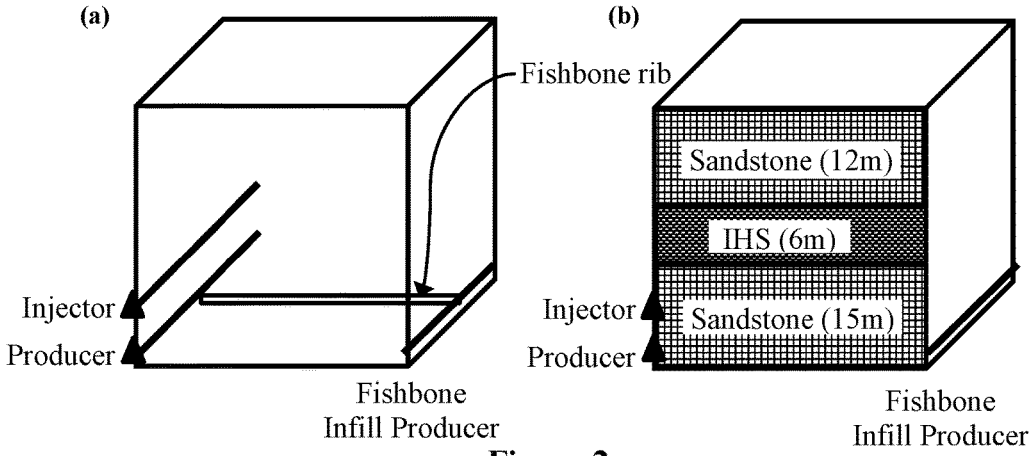
FIG. 2 depicts a 3D simulation model for CMG STARS including (a) a symmetric simulation model representing the repeatable pattern with a half SAGD wellpair, a half fishbone infill producer, and a fishbone rib connected from the infill producer and (b) a rock facies in model.

A 3D symmetric model representing the repeatable pattern with SAGD wellpair and fishbone infill producer, as shown in FIG. 1, is used for simulation using CMG STARS. The model, with dimension of 62.5 m×133.3 m×33 m, consists of a half SAGD wellpair with a producer located at the bottom and an injector 5 m above, and a half fishbone infill producer 62 m laterally apart from the producer. The fishbone rib connected to the infill producer is simulated with extremely high permeability grids, as shown in FIG. 2(*a*). The 3D model is the layered model with two facies, sandstone and IHS. A 6 m IHS layer is inter-bedded in the sandstone pay, as shown in FIG. 2(*b*). The Surmont average reservoir properties are used in the simulation.

The new process is named Fishbone_SAGD+CoINJ in simulation. After two years of SAGD operation, 1 mol % methane ($CH_4$) is coinjected with steam until the end of production. Three additional cases are simulated as comparison to the Fishbone_SAGD+CoINJ case, i.e., the Fishbone_SAGD case that operates SAGD in the same fishbone well configuration, the SAGD+CoINJ case that uses normal infill producer and coinjects 1 mol % CH4 after 8 years of SAGD operation, and the SAGD case that operates SAGD in the conventional wellpair with normal infill producer.

When comparing the coinjection timing between the Fishbone_SAGD+CoINJ and the SAGD+CoINJ cases, it is noticed that NCG coinjection can start after only 2 years of SAGD operation with 20% oil recovery in the Fishbone_SAGD+CoINJ case, which is much earlier than the SAGD+CoINJ case where NCG coinjection cannot start until 8 years of SAGD operation with 40% oil recovery.

FIGS. 3 to 5 compare the simulation results of monthly oil rate, oil recovery and cumulative steam oil ratio, respectively. The new process outperforms the other three cases, as evidenced by fastest oil recovery and the lowest steam-oil ratio.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. US 2014-0034296, Chen, et al., "Well Configurations for Limited Reflux" (2014).
2. U.S. Ser. No. 14/524,205, Lo & Chen, "Alternating SAGD Injections," (2014)

The invention claimed is:

1. A process for producing hydrocarbons where the process comprises:

a) a reservoir having interbedded layers;
b) a horizontal wellpair comprising an injection well and a wellpair production well;
c) one or more infill production wells comprising two or more fishbone ribs drilled laterally from the infill production well to the wellpair production well;
d) initially injecting steam through said injection well;
e) establishing thermal communication between the thermal chamber and one or more infill production wells;
f) switching to non-condensable gas (NCG) and steam injection; and
g) producing hydrocarbons.

2. The process of claim 1 wherein said hydrocarbons are selected from the group consisting of heavy oil, bitumen, tar sands, extra heavy oil, and the like.

3. The process of claim 1 wherein said NCG are selected from the group consisting of air, carbon dioxide (CO2), nitrogen (N2), carbon monoxide (CO), hydrogen sulfide (H2S), hydrogen (H2), anhydrous ammonia (NH3), flue gas, and combinations thereof.

* * * * *